United States Patent [19]

Kawahara et al.

[11] Patent Number: 4,505,594

[45] Date of Patent: Mar. 19, 1985

[54] MULTI-FUNCTION ANALOGUE TYPE WATCH

[75] Inventors: Hisashi Kawahara; Hiroyuki Kihara; Masahiro Sase, all of Tanashi, Japan

[73] Assignee: Citizen Watch Co. Ltd., Tokyo, Japan

[21] Appl. No.: 634,486

[22] Filed: Jul. 26, 1984

[30] Foreign Application Priority Data

Jul. 26, 1983 [JP] Japan ..... 52-135060

[51] Int. Cl.[3] ..... G04B 23/02; G04B 19/04

[52] U.S. Cl. ..... 368/73; 368/80

[58] Field of Search ..... 368/72-74, 368/80, 185, 187, 250, 251

[56] References Cited

U.S. PATENT DOCUMENTS

| | | | |
|---|---|---|---|
| 4,205,519 | 6/1980 | Deruns | 368/73 |
| 4,223,523 | 9/1980 | Kamiyo | 368/74 |
| 4,259,737 | 3/1981 | Berney | 368/66 |
| 4,266,288 | 5/1981 | Berney | 368/28 |
| 4,358,840 | 11/1982 | Ono et al. | 368/251 |
| 4,419,019 | 12/1983 | Nishimura et al. | 368/74 |
| 4,433,918 | 2/1984 | Nishimura et al. | 368/74 |

*Primary Examiner*—Vit W. Miska

*Attorney, Agent, or Firm*—Spencer & Frank

[57] ABSTRACT

A multi-function analogue type watch using upcounters only for performing a variety of functions. In operation the counts of these upcounters are so adjusted that the differences therebetween represent the exact time relation between corrected or reset time and present time.

5 Claims, 13 Drawing Figures

(M1MODE)

(M2MODE)

(M3MODE)

(M4MODE)

(M5MODE)

(M6MODE)

(M7MODE)

(M8MODE)

(M9MODE)

(M10,M11MODE)

MULTI-FUNCTION ANALOGUE TYPE WATCH

BACKGROUND OF THE INVENTION

This invention relates to an analogue type watch having alarm and other functions as desired, and particularly to a multi-function analogue watch using same type counters and relatively simple electronic circuits, still providing as many different functions as desired.

A variety of attempts have been made in the hope of providing to a mechanical wrist watch an alarm function which an electronic or digital watch has.

In almost all the proposed alarm clock structures, there are provided a train of time gears for driving the hour and minute hands and another train of set gears for driving the set hand, one of time gears having a male projection (or female recess) and the counter one of set gears having a female recess (or male projection). When the hour and minute hands come to indicate a particular time for which the alarm clock is set, the male projection of the selected time (or set) gear falls in the female recess of the selected set (or time) gear, thereby causing an associated switch to turn "on" for producing an electric signal in a set time detector, and finally alarming. The set time detector is composed of many parts. When it is desired that the alarm clock is set for a particular time, a thumb button for setting the alarm clock is rotated to drive and put the time and set gears in a right positional relationship with each other through the agency of an associated power transmission. The power transmission is composed of many parts, too. Thus, the number of assembling steps, and hence the cost the cost for assembling clocks increase accordingly. Still disadvantageously the alarm clock cannot be set for any particular time with accuracy, and a set time cannot be detected with accuracy, either. An alarm clock has an inner space enough to accommodate a set time detector and a power transmission. But a wrist watch has no sufficient space therein. Stated otherwise such alarm mechanism cannot be packed in without increasing the size of the wrist watch, and sometimes the degrees of freedom are limited in designing the appearance of the wrist watch. Recently, analogue watches have been increasingly in favour of customers, and accordingly there has been an ever increasing demand for analogue watches having as many functions as digital watches as for instance chronograph, dual-time, calendar, etc. in addition to alarm. Thus, manufacturers have a strong desire for making up such multi-function analogue type watches.

In U.S. Pat. Nos. 4,358,840 and 4,419,019, there were proposed such analogue type watches that can provide multi-function by using a plurality of up-down counters. As is well known, however, the up-down counters are complicated in circuit structure and in control of switching up and down terminals according to controlling signals.

SUMMARY OF THE INVENTION

The object of this invention is to provide a multi-function analogue type watch with relatively simple electric circuits built in.

To attain this object a multi-function analogue type watch according to this invention uses an up-counter for measuring time, an up-counter for moving hour and minute hands, and up-counters for performing alarm and other functions, thereby storing a relative difference between present time, needle position (that is, time indicated by the hour and minute hands of the watch) and function time (that is time at which a given function is performed) in the form of count difference between associated counters, and indicating present time and performing alarm and other functions as desired.

Other objects and advantages of this invention will be understood from the following description of a preferred embodiments.

DESCRIPTION OF THE PREFERRED EMBODIMENT

Figure 1:
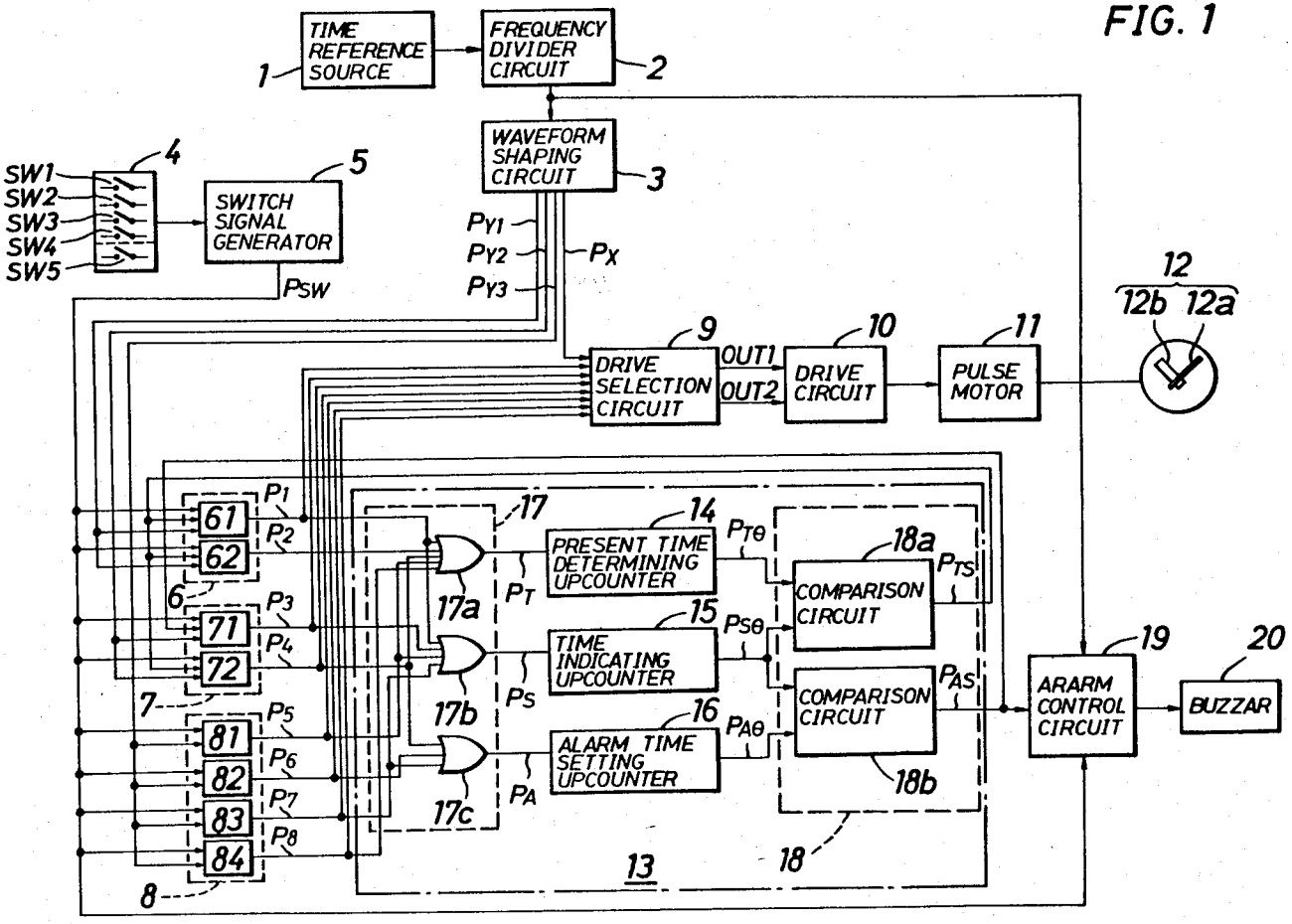
FIG. 1 is a block diagram of a multi-function analogue watch according to one embodiment of this invention.

FIG. 1 shows a multi-function analogue type watch according to one embodiment of this invention. As shown, it is of two-hand type (i.e., hour-and-minute hand type) and is has an alarm function.

In FIG. 1, a time reference source which may comprise a crystal oscillator is used to generate a given reference signal, for instance, of 32,768 Hertz. A frequency divider circuit 2 is composed of a series of divider units. The reference signal when passing through the series of dividers one after another, reduces in frequency accordingly.

A time signal derived from a selected division stage in the frequency divider circuit, is directed to a waveform shaping circuit 3. Then, the time signal is converted to a hand or needle-drive signal (one-minute period signal) $Py_1$, a quick-drive signal $Py_2$ (64 Hertz), as required for shifting from one mode (for instance, time indicating mode) to another mode (for instance, alarming mode), a time correction signal $Py_3$ ranging from 1 to 64 Hertz, and a reference wave signal Px (64 Hertz), from which pulse signals for driving the hour and hands forward and those for driving the hour and minute hands backward are produced.

A group of switches 4 are operatively connected to the winding crown of the wrist watch. Specifically, the exterior switches $SW_1$ and $SW_2$ may be rotated clockwise to turn "on" or may be rotated counterclockwise to turn "off" after having pulled up the winding crown one step high whereas the exterior switches $SW_3$ and $SW_4$ may be rotated clockwise to turn "on" or may be rotated counterclockwise to turn "off" after having pulled up the winding crown two steps high. The remaining exterior switch $SW_5$ may be turned "on" or "off" with the aid of an auxiliary button. Different "on"-and-"off" combinations of these exterior switches cause application of different signals to the input terminal of a switch signal generator 5, and then the switch signal generator 5 outputs different switch signals Psw depent on which exterior switches are turned "on" or "off". These different switch signals correspond to eleven modes in Table 1 described later.

A time drive control 6 is responsive to the switch signal Psw and the hand drive signal $Py_1$ for performing continuous time measurement, and is shown as comprising a normal drive control 61 for providing a one-minute period normal drive signal $P_1$ and a lapse time processing circuit 62 for providing one-minute period lapse time processing signal $P_2$.

A function switching control 7 is responsive to the switch signal Psw and the quick-drive signal $Py_2$ for switching present time display to alarm, and is shown as comprising a "shift-to-alarm" circuit 71 for providing a "shift-to alarm" signal $P_3$ and a "reset-to-time presentation" circuit 72 for providing a "reset-to-time presentation" control signal $P_4$.

Figure 2A:
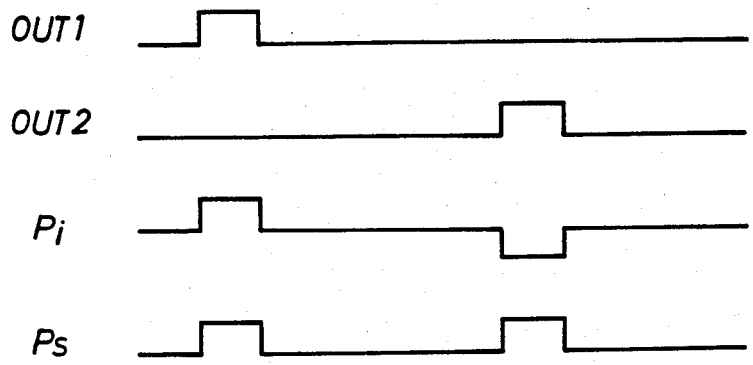
FIG. 2A shows waveforms of forward-drive pulses appearing at the output terminals of a drive selection circuit and FIG. 2B shows waveforms of backward-drive pulses appearing at the output terminals of a drive selection circuit and FIGS. 3A to 3J show counts in three up-counters along with the positions of the hour and minute hands in different modes of operation.
Figure 2B:
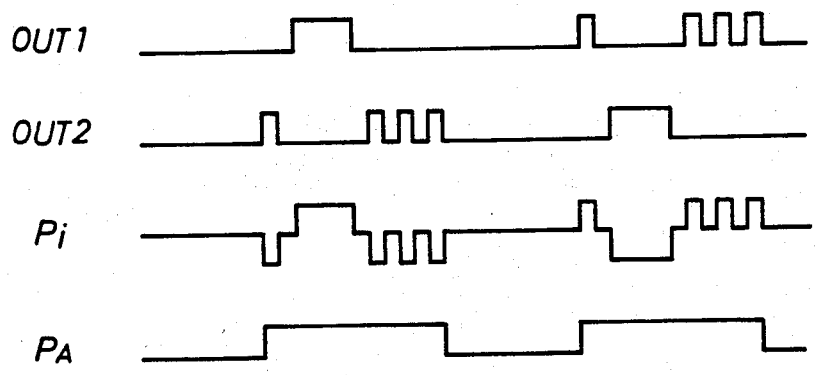

A time correction control 8 is responsive to a selected switch signal Psw and the time correction signal $Py_3$ for correcting time, and is shown as comprising a forward advance time correction circuit 81 for providing a forward advance time correction signal $P_5$, a backward advance time correction circuit 82 for providing a backward advance time correction signal $P_6$, a forward advance alarm time correction circuit 83 for providing a forward advance alarm time correction signal $P_7$ and a backward advance alarm time correction circuit 84 for providing a backward advance alarm time correction signal $P_8$. A drive selection circuit 9 uses a reference waveform signal Px from the waveform shaping circuit, and provides drive pulse for advancing forward the minute hand or drive pulses for driving backward the minute hand at its output terminals OUT1 and OUT2 under the control by the time drive control 6, function switching control 7 and the time correction control 8. Specifically, any one of the normal drive signal $P_1$ from the time drive control 6, the "shift-to-alarm" signal $P_3$ from the function switching circuit 7, the forward advance time correction signal P and the forward advance alarm time correction signal P is applied to a corresponding input terminal of the drive selection circuit 9, and then forward drive pulses as shown in FIG. 2A appear at the output terminal OUT1 and OUT2 of the drive selection circuit 9. Any one of the lapse time processing, signal $P_2$, the "reset-to-time presentation" control signal $P_4$, the backward advance time correction signal $P_6$ and the backward advance alarm time correction signal $P_8$ is applied to a corresponding input terminal of the drive selection circuit 9, and then backward drive pulse signals as shown in FIG. 2B appear at the output terminals OUT1 and OUT2. The waveform of the backward drive pulse signal as shown in FIG. 2B is different from that of the forward drive pulse signal as shown in FIG. 2A. This is attributable to the fact that the stationary stable position of the rotor of the hand driving pulse motor is different from the magnetic stable position of the rotor of the pulse motor at the time of being energized. No further description is deemed unnecessary because the method of applying drive pulses is well known.

A drive circuit 10 is composed of a pair of MOS inventors, and is responsive to forward or backward drive pulses from the drive selection circuit 9 for supplying the electromagnet coil of a pulse motor with drive current pulses $P_1$ which alternately change in polarity as shown in FIGS. 2A and 2B.

The shaft by the pulse motor II is in engagement with a train of gears (not shown) via a pinion gear fixed to the shaft of the pulse motor, and the minute and hour hands 12*a* and 12*b* are connected to selected ones among the train of gears.

Now, a count operation circuit 13 which takes an important role in the present invention is described.

The count operation circuit 13 is designed to continuously perform different count operations, in each working mode of the watch for determining instantaneous or present time in terms of count, shift of the hand position (i.e., indicated time) from exact present time, and the relative count position of a particular set alarm time with respect to exact present time, and for storing these count results all the time. The count operation circuit 13 comprises an upcounter 14 for determining instantaneous or present time in terms of count; an upcounter 15 for determining a particular time actually indicated by the hour and minute hands in terms of count; an upcounter 16 for determining and storing a set alarm time in terms of count; and an input control circuit 17 composed of three OR circuits 17*a*, 17*b* and 17*c* connected to the input terminals of the upcounters 14, 15 and 16 respectively; and a coincidence circuit 18 for comparing the output signal $P_{T0}$ from the upcounter 14 with the output signal $P_{S0}$ from the upcounter 15, and the output signal $P_{S0}$ from the upcounter 15 with the output signal $P_{A0}$ from the upcounter 16 and for generating coincidence signals at the time of coincidence in these output signals from the upcounters 14, 15 and 16.

The signals $P_1$, $P_2$, $P_4$, $P_5$ and $P_8$ are applied to the OR circuit 17*a*; the signals $P_1$, $P_3$, $P_5$ and $P_7$ are applied to the OR circuit 17*b*; and the signals $P_4$, $P_6$ and $P_7$ are applied to the OR circuit 17*c*. The time advance control signal $P_T$ from the OR circuit 17*a* is applied to and is counted in a present time determining upcounter 14, the hand advance control signal $P_S$ from the OR circuit 17*b* is applied to and is counted in the time indicating upcounter 15; and the alarm set control signal $P_A$ is applied to and is counted in the alarm time setting upcounter 16.

The coincidence circuit 18 is composed of two comparison circuits 18*a* and 18*b*. The comparison circuit 18*a* is allotted for comparing present time signals $P_{T0}$ from the present time determining upcounter 14 with the indicated time signals $P_{S0}$ from the indicated time upcounter 15 and for generating a coincidence signal $P_{TS}$ at the time of coincidence of present time and indicated time. On the other hand, the comparison circuit 18*b* is allotted for comparing the indicated time signals $P_{S0}$ with the alarm time signals $P_{A0}$ and for generating a coincidence signal $P_{AS}$ at the time of coincidence. The coincidence signal $P_{TS}$ representing the coincidence of present time and indicated time is directed to the normal drive control 61 and the lapse time processing circuit 62 of the time drive control 6 and the time mode return circuit 72 of the function switching circuit 7. The other coincidence signal $P_{AS}$ representing the coincidence of alarm time and indicated time is directed to a "shift-to-alarm" circuit 71 of the function switching control 7 and to an alarm control circuit 19 which controls the output of an alarm signal according to the switch signal $P_{SW}$. The alarm signal is formed from a reference signal of four or eight Kilohertz derived from a selected stage in the divider circuit 2. A buzzer 20 is responsive to the alarm signal from the alarm control circuit 19 for sounding.

Now, the functions and working modes of the analogue watch are described.

FIGS. 3A to 3J show, in each mode the counts of the present time upcounter 14, the indicated time upcounter 15 and the alarm time upcounter 16 and the manners of changing the counts along with the position of the four and minute hands. The analogue watch can work in different modes M1 to M11. Among these modes a desired one can be selectively be selectively by operating the exterior switches SW1 to SW5 and by using the coincidence signals $P_{TS}$ and $P_{AS}$. Table shows different distributions of signals $P_1$ to $P_8$ in these modes M1 to M11. The star mark * indicates that the switch SW5 which is operated by the auxiliary button, may be put in either condition, "on" or "off".

TABLE 1

| | Exterior Switches | | | | | Output Signal | | | | | | | |
|---|---|---|---|---|---|---|---|---|---|---|---|---|---|
| Mode | SW1 | SW2 | SW3 | SW4 | SW5 | $P_1$ | $P_2$ | $P_3$ | $P_4$ | $P_5$ | $P_6$ | $P_7$ | $P_8$ |
| M1 | L | L | L | L | * | O | | | | | | | |
| M2 | L | L | L | H | * | | | | | | | | |
| M3 | L | H | L | H | * | | | | | O | | | |
| M4 | H | L | L | H | * | | | | | | O | | |
| M5 | L | L | H | L | * | | | O | | | | | |
| M6 | L | H | H | L | * | | | | | | | O | |
| M7 | H | L | H | L | * | | | | | | | | O |
| M8 | L | L | L | L | * | | | | O | | | | |
| M9 | — | — | — | L | * | | O | | | | | | |
| M10 | L | L | L | L | L | O | | | | | | | |
| M11 | L | L | L | L | H | O | | | | | | | |

For the sake of simplicity in FIGS. 3A to 3J the present time determining upcounter 14, the indicated time representing upcounter 15 and the alarm time setting upcounter 16 are indicated by "$C_T$", "$C_S$" and "$C_A$", and the count results of these upcounters are represented by "$c_t$", "$c_s$" and "$c_a$".

Figure 3A:
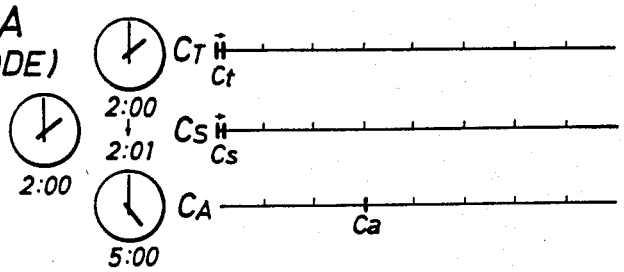

"M1" mode (present time measuring mode: FIG. 3A)

In this "M1" mode neither winding crown nor auxiliary button is actuated, and the hour and minute hands advance at normal speed. Table 1 shows that in this "M1" mode the exterior switches $SW_1$ to $SW_4$ are in the condition of "off", and only the normal drive signal $P_1$ from the normal drive control 6 is used. The normal drive signal $P_1$ is a one-minute period signal $P_{Y1}$ from the waveform shaping circuit 3, and is directed both to the present time measuring upcounter 14 and the indicated time representing upcounter 15 through the associated OR circuits 17*a* and 17*b* respectively, the signal $P_1$ is directed to the drive selection circuit 9 to produce at its output terminals OUT1 and OUT2 forward advance pulses as shown in FIG. 2A. As a result the minute hand 12*a* is made to advance step by step in every minute by the step motor 11 under the control of the drive circuit 10.

FIG. 3A shows the counts in the upcounters $C_T$, $C_S$ and $C_A$ in the "M1" mode: 2:00 o'clock for present time, 2:00 o'clock for indicated time and 5:00 o'clock for time set for alarm. In this "M1" mode, the count $c_t$ in the present time measuring upcounter $C_T$ and the count $c_s$ in the indicated time representing upcounter $C_S$ increase in the exact pace with each other at all times, and therefore the comparison circuit 18*a* continues to output the coincidence signal $P_{TS}$, which is directed both to the normal drive control circuit 61 of the time drive control circuit 6 and the "reset-to-time presentation" circuit 72 of the function switching control 7.

As a result the normal drive signal $P_1$ is outputted every minute by the time drive control circuit 61, and is applied both to the upcounters 14 and 15 through the OR circuits 17*a* in the lapse of one minute the counts $c_t$ and $c_s$ step one minute ahead, as indicated by arrow, thus renewing present time for 2:01 and indicated time for 2:01, respectively. The signals counted in the upcounters $C_T$ and $C_S$ are those $P_S$ which are shown in FIG. 2A.

In this "M1" mode no signals other than normal drive signal $P_1$ appear, and no alarm time control signal $P_A$ is applied to the alarm time setting upcounter 16, so that the count $c_a$ remains unchanged (in this particular case it remains 5:00). The comparator 18*a* of the coincidence circuit 18 outputs a coincidence signal $P_{TS}$, which is applied both to the normal drive control 61 and the "reset-to-time presentation" circuit 72. The feedback of the coincidence signal $P_{TS}$ (="H") to the normal drive control circuit 61 causes the time drive control 61 to continuously output the hand-drive signal $P_{Y1}$ as $P_1$. On the other hand, the application of the coincidence signal $P_{TS}$ (="H") to the "reset-to-time presentation" circuit 72 inhibits the same from outputting the signal $P_4$.

Figure 3B:
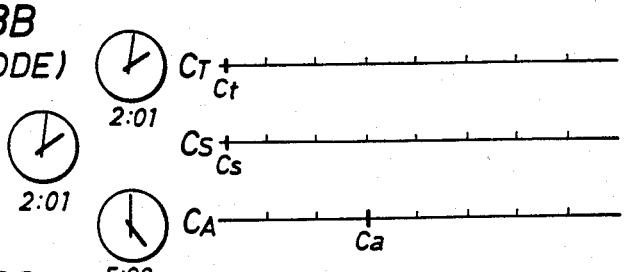

"M2" mode ("ready-for-time correction" mode: FIG. 3B)

In this "M2" mode as a precedent to time correction, the winding crown are pulled up two steps high, and only the exterior switch SW4 is turned "on" and the signals $P_1$ to $P_8$ do not appear from time drive control 6, the function switching control 7 and the time correction control 8. Therefore, the counts of the upcounters $C_T$, $C_S$ and $C_A$ remain unchanged, that is, $c_t$=2:01; $c_s$=2:01 and $c_a$=5:00.

As a matter of course in the "M2" mode the hour and minute hands lie still.

Figure 3C:
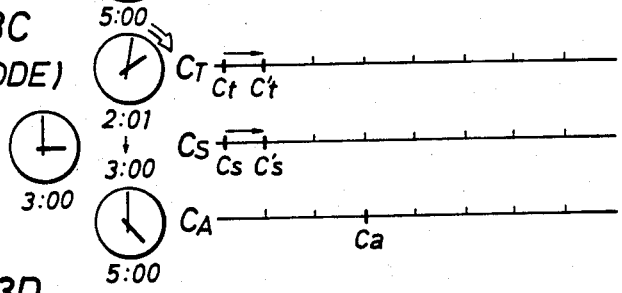

"M3" mode (forward time correction mode: FIG. 3C)

In this "M3" mode as a subsequent to "M2" mode, the hour and minute hands are mode to advance forward for the purpose of time correction. Then the winding crown is pulled up two steps high, and thereafter the winding crown is rotated counterclockwise. As seen from Table 1, in this "M3" mode the exterior switches SW1 and SW3 are put in the condition of "off", whereas the exterior switches SW2 and SW4 are put in the condition "on". The forward time correction signal $P_5$ appears at the output terminal of the forward time correction circuit 81 of the time correction control 8. In this case the signal $P_S$ is a time correction signal $P_{Y3}$ from the waveform shaping circuit 3.

As shown in FIG. 3C, when it is desired that the watch is advanced forward from 2:01 to 3:00, the winding crown is rotated counterclockwise and then the forward time correction signal $P_5$ is directed to the upcounters 14 and 15 through the OR circuits 17*a* and 17*b*, thus causing the counts $c_t$ and $c_s$ to simultaneously advance step by step.

The count $c_a$ of the upcounter 16 remains unchanged, and therefore the set alarm time remains as it was. The drive selection circuit 9 outputs forward advance pulses of minimum definition of one minute (see FIG. 2A) which are formed therein from the reference wave signal Px and the forward time correction signal $P_S$, thus driving the hour and minute hands forward at an increased speed. When the hour and minute hands 12 have reached the position of 3:00, the winding crown is rotated counterclockwise to return to "M2" mode, and then the forward time correction is completed. The count results of the upcounters $C_T$, $C_S$ and $C_A$ are shown in FIG. 3C. Specifically, $c'_t = c'_s = 3{:}00$ and $c_a = 5{:}00$, and the difference between these counts is equal to 120 ($=60\times2$), which count difference corresponds to two hours. When the forward time correction is finished, the winding crown is pushed down to return to the present time measuring mode "M1".

Figure 3D:
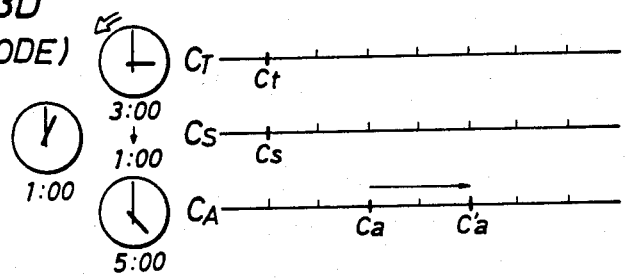

"M4" mode (backward time correction mode: FIG. 3D)

In this "M4" mode as a subsequent to "M2" mode, the hour and minute hands are driven backward for the purpose of time correction. Then, the winding crown is pulled up two steps high, and thereafter the winding crown is rotated clockwise.

As seen from Table 1, in this "M4" mode the exterior switches SW1 and SW4 are put in the condition of "on" whereas the other switches SW2 and SW3 are put in the condition of "off". Then, only the backward time correction signal $P_6$ appears at the output terminal of the backward time correction circuit 82 of the time correction control 8. This signal $P_6$ is, in fact, a time correction signal $P_{Y3}$ from the waveform shaping circuit 3, as is the case with the "M3" mode already, described.

As shown in FIG. 3D, when it is described that the watch is advanced backward from 3:00 to 1:00, the winding crown is rotated clockwise, and then the backward time correction signal $P_6$ which is, in fact, a signal $P_G$ shown in FIG. 2(*b*) is directed only to the upcounter 16 through the OR circuit 17C so that the count $c_a$ in the upcounter $C_A$ increases by 120 ($=60\times2$), corresponding to two hours. On the other hand, the counts $c_t$ and $c_s$ of the upcounters $C_T$ and $C_S$ remain unchanged.

The drive selection circuit 9 outputs backward drive pulses (as least definition as one minute: See FIG. 2B), which are formed therein from the reference waveform signal $P_X$ and the backward correction signal $P_6$, and then the minute and hour hands 12*a* and 12*b* are driven backward at an increased speed through the agency of the drive circuit 10, the pulse motor 11 and associated gear trains. When the hour and minute hands have come to the position of 1:00, the winding crown is rotated clockwise to return to the "M2" mode, thus completing the backward correction. Then, the winding crown is pushed to return to present time increasing mode "M1".

FIG. 3D shows the counts of the upcounters $C_T$, $C_S$ and $C_A$; $c_t$ is equal to $c_s$, and $c_t$ ($=c_s$) is 240 ($=60\times4$) behind from $c'_a$, corresponding to four hours.

As described above, an analogue type watch according to this invention exclusively uses upcounters $C_T$, $C_S$ and $C_A$ which are advantageously simple in structure and easy in control, and then, in this particular example, the four-hour long difference between the corrected time (1:00) and the set alarm time (5:00) is retained by advancing forward only the count of the upcounter $C_A$ as much count as corresponds to the four hour long difference. This unique processing permits the backward time correction of the watch in spite of the exclusive use of upcounters, avoiding the complicatedness in structure and the difficulty in control which would be caused by using updown counters.

Figure 3E:
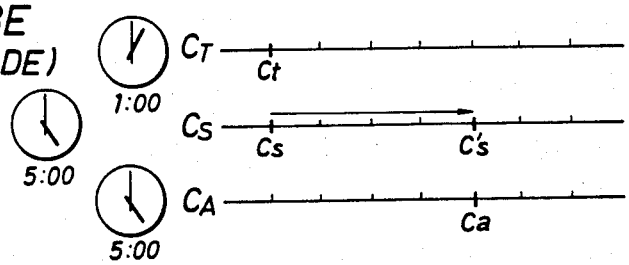

"M5" mode ("present-to-alarm time" shift mode: FIG. 3E)

This "M5" mode permits the presentation of a set alarm time (5:00 in the above described example) for confirmation in place of the presentation of in place of the presentation of present time on the watch. Such monitor mode can be realized simply by pulling up the winding crown one step high and by rotating the same counterclockwise.

In the "M5" mode only the switch SW3 is turned "on" whereas the other switches SW1, SW2 and SW4 are turned "off", as seen from Table 1. A "shift-to-alarm" signal $P_3$ appears at the output terminal of the "shift-to-alarm" circuit 71 of the function switching control 7. This signal $P_3$ is a quick-drive signal $P_{Y2}$ (64 Hz) supplied from the waveform shaping circuit 3. Assume that it is now one o'clock and that the watch is shifted to "M5" mode for confirmation of the time for which the watch is set for alarming. The "shift-to-alarm" signal $P_3$ is directed only to the upcounter $C_S$ through the OR circuit 17*b*, thus increasing the count $c_s$ at an increased speed as high as 64 Hertz.

Then, forward drive pulses at as high a rate as 64 Hertz are formed from the reference waveform signal $P_X$ and the signal $P_3$ to appear at the output terminals OUT1 and OUT2 of the drive selection circuit 9 (See FIG. 2A). Thus, the minute and hour hands 12*a* and 12*b* rotates at an increased speed through the agency of the drive circuit 10, the pulse motor 11 and associated gear trains.

The counts $c_t$ and $c_a$ of the other two upcounters $C_T$ and $C_A$ remains unchanged.

The count $c_s$ of the upcounter $C_S$ increases high up to $c'_s$, and then the count $c_s$ of the upcounter $C_S$ is brought in coincidence with the count $c_a$ of the upcounter $C_A$, thus causing the comparator 18*b* of the coincidence circuit 18 to output a coincidence signal $P_{AS}$ of "H". This coincidence signal $P_{AS}$ is directed to the "shift-to-alarm" circuit 71 of the function switching circuit, thereby inhibiting the "shift-to-alarm" signal $P_3$ from appearing at the output terminal of the "shift-to-alarm" circuit 71. As a result, the hour and minute hands stop when the count $c'_s$ of the upcounter $C_S$ has been brought in coincidence with the count $c_a$ of the upcounter $C_A$, that is, the hour and minute hands have indicated the time for which the watch is set for alarming, thus showing that the set alarm time is 5:00 from the position in which the hour and minute hands stop.

Also, the coincidence signal $P_{AS}$ is sent to the alarm control circuit 191. In the "M5" mode, however, the switch signal $P_{SW}$ disables the alarm control circuit 19 irrespective of the "on" or "off" condition of the switch SW5, thus preventing the buzzer 20 from sounding.

"M6" mode (forward alarm time reset mode: FIG. 3E)

In this "M6" mode as a subsequent to the "M5" mode, the watch is forward advanced to reset the same for a desired new time. The winding crown is pulled up one step high and then it is rotated counterclockwise. Then, the hour and minute hands start, rotating forward or clockwise. When the hour and minute hands have reached a desired time for alarming, the winding crown is again rotated counterclockwise, and then the hour and minute hands stop, thus completing the resetting of the alarm watch.

In the "M6" mode, the exterior switches SW2 and SW3 are turned "on" whereas the other switches SW1 and SW4 are turned "off", and the forward alarm time resetting signal $P_7$ appears at the output terminal of the forward alarm time resetting circuit 83. The signal $P_7$ is a time correction signal $P_{Y3}$ from the waveform shaping circuit 3.

Figure 3F:
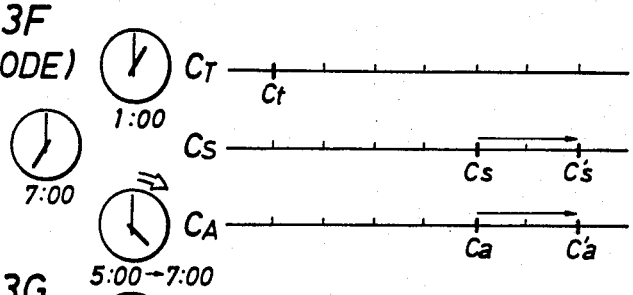

Assume that it is now one o'clock and that it is desired that the watch is reset for seven instead of five (See FIG. 3F). The forward alarm time resetting signal $P_7$ is directed both to the indicated time upcounter $C_S$ and the alarm time upcounter $C_A$, so that the counts of these upcounters increase simultaneously. The count $c_t$ of the present time up counter $C_T$, however, remains unchanged.

Forward drive pulses are formed from the signal $P_7$ and the reference waveform signal Px in the drive selection circuit 9, and the hour and minute hands are rotated forward through the agency of the drive circuit 10, the pulse motor 11 and associated gear trains.

When the hour and minute hands have come to indicate a desired alarm time, that is, 7:00, the winding crown is rotated counterclockwise. Then, the hour and minute hands stop, and the forward alarm time resetting signal $P_7$ stops, thus keeping the count $c'_s$ of the upcounter $C_S$ and the count $c'_a$ of the upcounter $C_A$ coincident to each other (this corresponding to the alarm time monitoring mode, that is, the "M5" mode).

Then, the count $c'_s$ of the upcounter $C_S$ is equal to the count $c'_a$ of the upcounter $C_A$, and the count $c'_s$ $(=c'_a)$ is 360 $(=60\times 6$: six hours) ahead of the count $c_t$ of the upcounter $C_T$.

In the "M6" mode, the counts of the upcounters $C_S$ and $C_A$ are equal to each other at all times so far as forward alarm time resetting pulses P are applied both to these upcounters. Therefore, the coincidence circuit 18 outputs a coincidence signal $P_{AS}$, and the alarm control circuit 19 under the control of the switch signal $P_{SW}$ is disabled irrespective of the "on" or "off" condition of the switch SW5, thus preventing the buzzer 20 from sounding, as is the case with the "M5" mode.

Figure 3G:
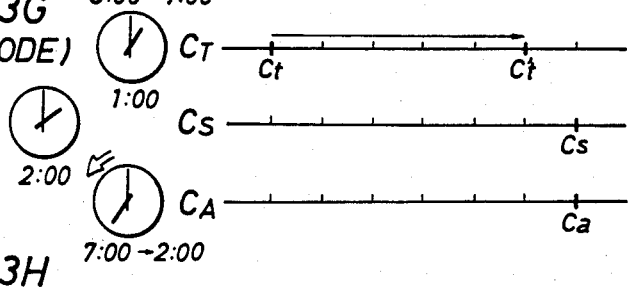

"M7" mode (backward alarm time resetting mode: FIG. 3G)

In this "M7" mode the watch is backward driven to reset the same for a desired new alarm time. The "M7" mode is subsequent to the "M5" mode in which the counts $c_a$ and $c_s$ of the upcounters $C_A$ and $C_S$ are equal to each other. In the "M7" mode the winding crown is pulled up one step high, and then it is rotated clockwise to set the hour and minute hands to a desired alarm time.

In this "M7" mode the exterior switches SW1 and SW3 are turned "on" whereas the other switches SW2 and SW4 are turned "off". The backward alarm time resetting signal appears at the output terminal of the backward alarm time resetting circuit 84. This signal $P_8$ is a time correction signal $P_{Y3}$.

Assume that it is now one o'clock and that it is desired that the watch is reset for two instead of seven (See FIG. 3G). The backward alarm time resetting signal $P_8$ is directed to the present time upcounter $C_T$ through the OR circuit 17*a*, thus increasing the count c of the present time upcounter $C_T$.

The counts $c_s$ and $c_a$ of the other upcounters $C_S$ and $C_A$, however, remain unchanged $(c_s=c_a)$. Backward drive pulses are formed from the signal $P_8$ and the reference waveform signal Px in the drive selection circuit 9 to appear at the output terminals OUT1 and OUT2 of the drive selection circuit 9 (See FIG. 2B). The drive selection circuit 10 is responsive to these drive pulses for driving the pulse motor 11 and hence the hour and minute hands 12 in the backward direction. When the hour and minute hands 12 have reached the position in which these hands indicate a renewed alarm time, that is, 2:00, the winding crown is rotated clockwise, so that the backward alarm time resetting signal $P_8$ stop. As a result, the hour and minute hands 12 stop, and at the same time, the upcounter $C_T$ stops. Then, the watch returns to the alarm time confirming mode, that is, "M5" mode.

The then count $c_{t'}$ of the upcounter $C_T$ is 60 $(=60\times 1$; one hour) behind the then count $c_s$ of the upcounter $C_S$, which is equal to the count $c_a$ of the upcounter $C_A$.

From the above, it should be noted that even in the backward alarm time resetting mode the upcounter $C_T$ increases its count from $c_t$ to $c_{t'}$ as is the case where the "M4" mode in which the upcounter $C_A$ increases its count from $c_a$ to $c'_a$. This sort of processing permits the exclusive use of upcounters for backward alarm time resetting, thus unnecessitating the use of updown counters which are complicated in structure and difficult in control.

Figure 3H:
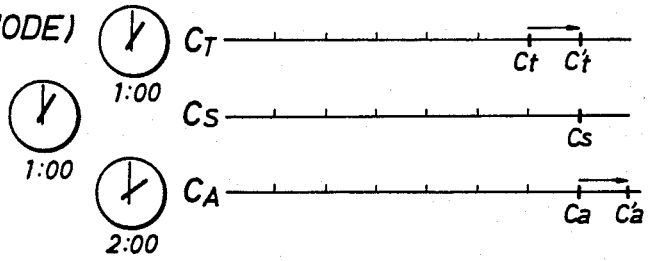

"M8" mode (alarm confirmation-to-present time display switching mode: FIG. 3H)

In this "M8" mode the watch is switched to the normal present time display after the completion of alarm time confirmation or alarm time resetting by pushing down the winding crown which was pulled up one step high, for instance, in the precedent "M5" mode.

In this "M8" mode all the exterior switches SW1 to SW4 are turned "off", and the "reset-to-time presentation" signal $P_4$ appears at the output terminal of the "reset-to-time presentation" circuit 72 of the function switching control 7. This signal $P_4$ is a quick-drive signal of 64 Hertz $P_{Y2}$.

Assume that it is now one o'clock and that it is desired that the watch is reset for one instead of two. The "reset-to-time presentation" signals $P_4$ are directed both to the present time upcounter $C_T$ and the alarm time upcounter $C_A$ through the OR circuits 17*a* and 17*c*, thus causing these upcounters to increase their counts simultaneously. On the other hand, the count $c_s$ of the upcounter $C_S$ remains unchanged.

Backward drive pulses are formed from the "reset-to-time presentation" signal $P_4$ and the reference waveform signal $P_Y$ in the drive selection circuit 9, to appear at the output terminals OUT1 and OUT2 of the drive selection circuit 9. The drive circuit 10 is responsive to the backward drive pulses for driving the pulse motor and hence the hour and minute hands from 2:00 to 1:00 at an increased speed until the coincidence of the count $c_{t'}$ of the upcounter $C_T$ and the count $c_s$ of the upcounter $C_S$. Then, a coincidence signal $P_{TS}$ appears at the output terminal of the comparator 18*a*. The "reset-to-time presentation" circuit 72 is responsive to the coincidence signal $P_{TS}$ for inhibiting "reset-to-time presentation" signals from appearing at its output terminals. As a result the hour and minute hands stop to indicate 1:00.

Thus, the count $c_{t'}$ of the present time upcounter $C_T$ and the count $c_s$ of the indicated time upcounter $C_S$ are brought in coincidence to each other, and the count $c_a$ of the alarm time upcounter $C_A$ is 60 $(=60\times 1$; one hour) ahead of the count $c_{t'}$ or $c_s$ of the upcounter $C_T$ or $C_S$.

As seen from Table 1, the "M1" mode has the same "on"-and-"off" combination of the switches SW1 to SW4 as the "M8" mode, but these modes are still logically distinguishable because a coincidence signal $P_{TS}$ appears in the "M1" mode whereas no coincidence signal appears in the M8 mode.

Figure 3I:
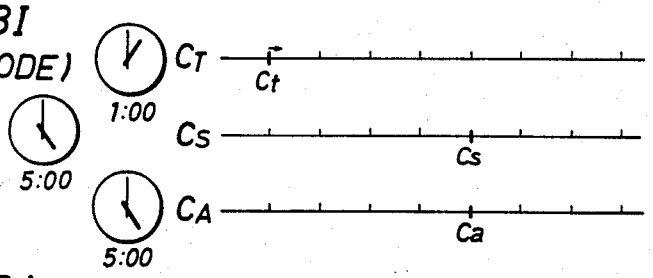
Figure 3J:
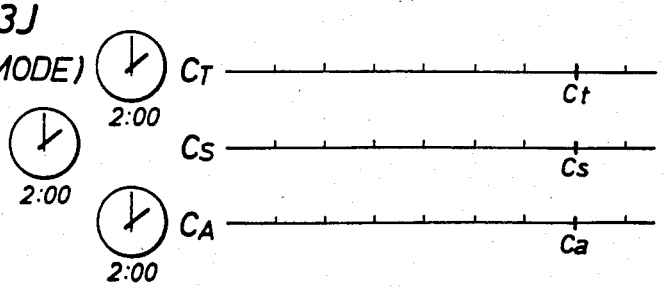

"M9" mode (lapse time processing mode: FIG. 3I)

In this "M9" mode a lapse of time lost during the shift to alarm time or present time display or during alarm time resetting is compensated. This mode proceeds with the "M5", "M6", "M7" and "M8" and "M10" modes, provided that the coincidence signal $P_{TS}$ is "L".

This "M9" mode, therefore cannot be present alone. In this "M9" mode the lapse time processing circuit 62 of the time drive control 6 outputs a lapse time processing signal $P_2$, which is a one-minute period drive signal $P_{Y1}$ from the waveform shaping circuit 3.

The "M9" mode is described with reference to the "M5" mode ("present-to-alarm time" shift mode) below. While the "M5" mode proceeds, the lapse time processing signal $P_2$ is directed only to the present time upcounter $C_T$ via the OR circuit 17*a*, and is counted therein.

Thus, the count $c_t$ of the upcounter $C_T$ increases every minute. The counts of the other upcounters $C_S$ and $C_A$ are not influenced by the lapse time processing signal, and the upcounter $C_S$ counts pulses $P_3$ in the "M5" mode.

"M10" and "M11" modes (alarm mode)

In this "M11" mode the buzzer sounds at the coincidence of present time and alarm time. In the "M10" mode the exterior switches SW1 to SW5 are turned "off" whereas in the "M11" mode the auxiliary button is depressed, and only the switch SW5 is turned "on". In either mode the normal drive signal $P_1$ appears at the output terminals of the normal drive control 61 of the time drive control 6.

The normal drive signal $P_1$ is a one-minute period signal, and it is directed both to the present time upcounter $C_T$ and the indicated time upcounter $C_S$ through the OR circuit 17*a* and the OR circuit 17*b* respectively, thus causing the counts of these upcounters to increase every minute. As is understood from the description of the "M1" mode, the counts $c_t$ and $c_s$ of the upcounters $C_T$ and $C_S$, are equal to each other.

When the count $c_s$ of the indicated time upcounter $C_S$ is brought in coincidence with the count $c_a$ of the present time upcounter $C_A$, the comparator 18*b* of the coincidence circuit 18 outputs a coincidence signal $P_{AS}$, which is directed both to the alarm control 19 and the "shift-to-alarm" circuit 71 of the function switching control 7.

In the "M10" mode the exterior switch SW5 is turned "off", and therefore the alarm control 19 outputs an alarm signal, thereby causing the buzzer 20 to sound.

In contrast to this in the "M11" mode the exterior switch SW5 is turned "on", and therefore the alarm control 19 outputs no alarm signal, thus not alarming.

A multi-function analogue type watch according to this invention is described above as an hour-and-minute hand type alarm wrist watch, but it should be noted that this invention can be reduced to practice in the form of analogue type watch having extra functions other than alarm function, such as chronograph, dual-time display (a desired foreign time displayed when switched), calendar, etc. Then, an upcounter is necessitated for each additional function.

As a matter of course, this invention can be equally applied to a three-hand type (hour-minute-and second-type) analogue watch. Then, each of the three upcounters is designed to count a one-second period signal, and is designed to advance every 43200 counts.

This invention is most advantageously applied to a wrist watch, but needless to say this invention can be equally applied to an alarm clock. Also, this invention can be applied to a watch or clock equipped with a time reference unit other than a crystal oscillator.

As is apparent from the above, a multi-function analogue type watch according to this invention uses three upcounters each allotted for determining present time, indicating present time and alarm setting.

In operation, the counts of these upcounters are so adjusted that the differences therebetween represent the exact time relation between corrected or reset time and present time. The exclusive use of upcounters makes an analogue type watch simple in structure and easy in control, avoiding the complicatedness in structure and the difficulty in control which would be encountered if updown counters were used.

What is claimed is:

1. A multi-function analogue type watch comprising:

a time reference source for generating a time reference signal;

a frequency divider circuit for dividing the frequency of the time reference signal and providing time signals of predetermined low frequencies;

a waveform shaping circuit for shaping the waveforms of the time signals into different wave shaped signals;

a group of exterior operating switches;

a switch signal generator for generating different switch signals dependent on which said exterior switches are operated;

a normal time drive control responsive to application of selected switch signals and selected wave-shaped signals for providing normal drive signals for time keeping;

a function switching control responsive to application of selected switch signals and selected wave-shaped signals for performing a switch from present time to any particular function time;

a time correction control responsive to application of selected switch signals and selected wave-shaped signals for providing time correction signals;

a drive selection circuit responsive to application of selected signals from said waveform shaping circuit, time drive control, function switching control and time correction control for providing drive signals dependent on which exterior switches are actuated;

a drive circuit responsive to application of drive signals for providing hand drive signals;

a motor responsive to application of hand drive signals for rotating; and hour and minute hands driven by the motor, characterized by:

a first upcounter allotted for measuring present time and for registering a count difference relative to a particular time indicated by the hour and minute hands;

a second upcounter allotted for representing a particular time indicated by the hour and minute hands and for registering a count difference relative to present time or function time;

a third upcounter allotted for determining a particular function time and for registering a count difference relative to a particular time indicated by the hour and minute hands;

an input control circuit for supplying input signals to the first, second and third upcounters;

a first coincidence circuit responsive to coincidence of the output signals from the first and second upcounters for providing a first coincidence signal;

a second coincidence circuit responsive to coincidence of the output signals from the second and the third upcounters for providing a second coincidence signal; and a hand position controlling circuit responsive to application of the coincidence signals for moving forward or backward the hour and minute hands at a normal or increased speed until the hour and minute hands have indicated a particular time as required.

2. A multi-function analogue type watch according to claim 1 wherein said normal time drive control is composed of:

a normal drive control circuit responsive to application of said first coincidence signal from said first coincidence circuit in a present time presentation mode; and a lapse time processing circuit for compensating the lapse time last during absence of the coincidence signal at said first coincidence circuit in a function time display mode or in a "reset-to-time presentation" mode.

3. A multi-function analogue type watch according to claim 1 wherein said time correction control is composed of:

a forward time correction circuit for performing a forward time correction during the appearance of said first coincidence signal at the output terminals of said first coincidence circuit;

a backward time correction circuit for performing a backward time correction during the appearance of said first coincidence signal;

a forward function time resetting circuit for performing a forward resetting during the appearance of said second coincidence signal at the output of terminals of said second coincidence circuit; and a backward function time resetting circuit for performing a backward resetting during the appearance of said second coincidence signal.

4. A multi-function analogue type watch according to claim 1 wherein said function switching control is composed of:

a "shift-to-another function" circuit which functions to keep said second upcounter running and at the same time forward drive the hour and minute hands at an increased speed until said second coincidence signal has appeared at the output terminals of said second coincidence circuit in a "shift-to-another function" mode; and a "reset-to-time presentation" circuit which functions to keep said first and third upcounters running and at the same time backward drive the hour and minute hands at an increased speed until said first coincidence signal has appeared at the output terminals of said first coincidence circuit.

5. A multi-function analogue type watch according to claim 1 wherein said function switching control is composed of: a "shift-to-another function" circuit which functions to keep said second upcounter running until said second coincidence circuit has outputted said second coincidence signal, and at the same time advance forward the hour and minute hands at an increased speed in a "shift-to-another function" mode; and a "reset-to-time presentation" circuit which functions to keep said first and third upcounters running until said first coincidence circuit has outputted said first coincidence signal in a "shift-to-time representation" mode;

said normal time drive control is composed of: a normal drive control circuit for providing normal drive signals during the appearance of said first coincidence signal at the output terminals of said first coincidence circuit in a present time presentation mode, thereby allowing said first and second upcounters to count said normal drive signals, and at the same time driving the hour and minute hands at a normal speed; and a lapse time processing circuit for providing lapse time processing signals during absence of said first coincidence signal in an another function time mode or a "reset-to-time representation" mode, thereby allowing said first upcounter to count the lapse time processing signals;

said time correction control is composed of: a forward time correction circuit for providing forward time correction signals, thereby performing a forward time correction during the appearance of said first coincidence signal at the output terminals of said first coincidence circuit, and at the same time, allowing said first and second upcounters to count forward time correction signals; a backward time correction circuit for providing backward time correction signals, thereby performing a backward time correction during the appearance of said first coincidence signal and at the same time, allowing said third upcounter to count the backward time correction signals; a forward function time resetting circuit for providing forward function time resetting signals, thereby performing a forward function time resetting during the appearance of said second coincidence signal at the output terminals of said second coincidence circuit and at the same time allowing said second and third upcounters to count the forward function time resetting signals; and a backward function time resetting circuit for providing backward function time resetting signals, thereby performing a backward function time resetting during the appearance of said second coincidence signal at the output terminals of said second coincidence circuit, and at the same time, allowing said first upcounter to count the backward function time resetting signals.

* * * * *